US010455316B2

(12) United States Patent
Madsen et al.

(10) Patent No.: US 10,455,316 B2
(45) Date of Patent: Oct. 22, 2019

(54) EARPHONE WITH EARPHONE HOUSING AND SPEAKER HOUSING

(71) Applicant: GN Audio A/S, Ballerup (DK)

(72) Inventors: Claus Ellegaard Madsen, Ballerup (DK); Kevin Han, Ballerup (DK)

(73) Assignee: GN Audio A/S (DK)

( * ) Notice: Subject to any disclaimer, the term of this patent is extended or adjusted under 35 U.S.C. 154(b) by 47 days.

(21) Appl. No.: 15/833,630

(22) Filed: Dec. 6, 2017

(65) Prior Publication Data

US 2018/0176673 A1 Jun. 21, 2018

(30) Foreign Application Priority Data

Dec. 15, 2016 (EP) ..... 16204281

(51) Int. Cl.
*H04R 1/10* (2006.01)

(52) U.S. Cl.
CPC ..... *H04R 1/1066* (2013.01); *H04R 1/105* (2013.01); *H04R 1/1008* (2013.01); *H04R 1/1025* (2013.01); *H04R 1/1058* (2013.01)

(58) Field of Classification Search
CPC ..... H04R 1/1008; H04R 1/025; H04R 1/105; H04R 1/1066; H04R 1/1058
See application file for complete search history.

(56) References Cited

U.S. PATENT DOCUMENTS 5,748,743 A 5/1998 Weeks
6,522,613 B1 2/2003 Frankeny
(Continued)

FOREIGN PATENT DOCUMENTS

DE 20 2016 104942 9/2016
GB 2441883 3/2008

OTHER PUBLICATIONS

Extended European Search Report dated May 29, 2017 for European patent application No. 16204281.6.

*Primary Examiner* — Md S Elahee
*Assistant Examiner* — Angelica M McKinney
(74) *Attorney, Agent, or Firm* — Hamre, Schumann, Mueller & Larson, P.C.

(57) ABSTRACT

Disclosed is an earphone for a hearing device, wherein the earphone is configured to be worn at the ear of a user, the earphone comprising: a speaker housing comprising an output transducer for reproduction of audio signals, wherein the speaker housing has a first side configured to face towards the ear of the user when the earphone is worn by the user, and a second side opposite the first side; an earphone housing configured to retain the speaker housing such that the second side of the speaker housing faces a first side of the earphone housing, wherein the earphone housing has as a second side opposite the first side; a battery compartment for accommodating a replaceable battery, such that the replaceable battery is located at least partly between the second side of the speaker housing and at least a portion of the earphone housing; wherein the earphone comprises a retaining mechanism configured to retain the speaker housing and the earphone housing in a mechanical relationship with each other; wherein the earphone comprises a locking mechanism for locking and unlocking of the retaining mechanism, wherein the locking mechanism is configured to maintain the retaining mechanism in an operation configuration when locked and to allow the user to manipulate the retaining mechanism into a service configuration by repositioning the speaker housing relative to the earphone housing when unlocked; wherein the earphone is configured such that the battery compartment is inaccessible for replacement of the battery, when the retaining mechanism is in the operation configuration, and such that the battery compart-
(Continued)

ment is accessible for replacement of the battery, when the retaining mechanism is in the service configuration; wherein the retaining mechanism further is configured to allow the speaker housing and the earphone housing to move relative to each other, when the retaining mechanism is in the operation configuration.

12 Claims, 9 Drawing Sheets

(56) References Cited

U.S. PATENT DOCUMENTS

| | | | | |
|---|---|---|---|---|
| 6,839,448 | B2 | 1/2005 | Chen | |
| 7,773,767 | B2 | 8/2010 | Wahl | |
| 8,160,287 | B2 | 4/2012 | Slippy | |
| 8,374,367 | B2 | 2/2013 | Nielsen | |
| 8,482,488 | B2 | 7/2013 | Jannard | |
| 8,953,815 | B2 | 2/2015 | Shinozaki | |
| 9,014,409 | B2 | 4/2015 | Steyn et al. | |
| 9,445,182 | B2 * | 9/2016 | Pizzaro | H04R 1/1058 |
| 9,510,079 | B1 * | 11/2016 | Pastorino | H04R 1/1008 |
| 10,149,033 | B2 * | 12/2018 | Karacal | H04R 1/1008 |
| 2004/0264720 | A1 | 12/2004 | Huang | |
| 2008/0132292 | A1 | 6/2008 | Hansen | |
| 2008/0304685 | A1 | 12/2008 | Fideler | |
| 2009/0268935 | A1 * | 10/2009 | Dillinger | H04R 1/1075 381/371 |
| 2011/0142249 | A1 * | 6/2011 | Shinozaki | H04R 1/1091 381/71.6 |
| 2012/0087534 | A1 * | 4/2012 | Pelland | H04R 1/1041 381/380 |
| 2012/0207320 | A1 * | 8/2012 | Avital | H04R 1/1041 381/74 |
| 2013/0195307 | A1 * | 8/2013 | Mizuno | H04R 1/1091 381/374 |
| 2013/0294633 | A1 * | 11/2013 | Steyn | H04R 1/1025 381/370 |
| 2014/0036127 | A1 * | 2/2014 | Pong | H04R 1/028 348/333.01 |
| 2015/0222980 | A1 | 8/2015 | Pizzaro et al. | |
| 2016/0196100 | A1 | 7/2016 | Yow et al. | |

* cited by examiner

EARPHONE WITH EARPHONE HOUSING AND SPEAKER HOUSING

FIELD

The present disclosure relates to an earphone for a hearing device. The earphone is configured to be worn at the ear of a user. The earphone comprises a speaker housing comprising an output transducer for reproduction of audio signals. The speaker housing has a first side configured to face towards the ear of the user when the earphone is worn by the user. The earphone comprises an earphone housing configured to retain the speaker housing.

BACKGROUND

U.S. Pat. No. 8,953,815 discloses that housings on the right/left hand side of the noise cancellation headphone, where a speaker unit is incorporated, are connected to each other with a headband, and a battery receiving portion is provided on a side surface of at least one of the right and left housings. The battery receiving mechanism includes: a battery receiving portion provided in the side surface of the housing; a battery lid opening and closing the battery receiving portion; and a flexible connecting member preventing the battery lid from dropping off from the housing in a state where the battery lid opens the battery receiving portion. The housing and the battery lid each include an engagement part which engages with each other by pushing in the battery lid in a direction intersecting with the side surface of the housing, and the battery lid occupies a part of the side surface of the housing.

U.S. Pat. No. 9,014,409 discloses an earcup assembly for a headset which includes a housing having a first side adapted to engage the head of a user when in use and a second side opposite thereto. A recess provided in the second side of the housing receives and stores a battery. A battery door is arranged to slidably engage with the second side of the housing such that the battery door may be moved between a first, open position in which the recess is accessible to a user and a second, closed position in which the recess is covered by the battery door. Preferably, the earcup assembly includes active noise reduction circuitry. One or a pair of such earcup assemblies may be arranged to form a headset, wherein the assemblies are coupled to a headband via yokes.

US20150222980 discloses a headset having rotatable ear cups. The headset includes a headband having a first end and a second end. An earphone unit is coupled to each end of the headband. The earphone unit includes an ear cup that is rotatable between a closed position and an open position.

US20080304685 discloses a method and apparatus for a modular hearing aid for a user having a hearing canal, including a housing adapted to fit within at least a portion of the hearing canal, and having at least one access port, a cover adapted for at least partially covering the at least one access port, and signal processing electronics connected to a microphone and a power supply. In various examples, a microphone housing is adapted to mount to the housing and to fit within the at least one access port, and to connect to the microphone, the signal processing electronics and the power supply. In one variant, the apparatus includes a receiver connected to the signal processing electronics, and a fastener as a unitary connector of the cover and microphone housing to the housing.

SUMMARY

There is a need for an improved earphone for a hearing device, which provides an improved arrangement for replacement of the replaceable battery in the earphone.

Disclosed is an earphone for a hearing device. The earphone is configured to be worn at the ear of a user. The earphone comprises a speaker housing comprising an output transducer for reproduction of audio signals. The speaker housing has a first side configured to face towards the ear of the user, when the earphone is worn by the user, and a second side opposite the first side. The earphone comprises an earphone housing configured to retain the speaker housing such that the second side of the speaker housing faces a first side of the earphone housing. The earphone housing has as a second side opposite the first side. The earphone comprises a battery compartment for accommodating a replaceable battery, such that the replaceable battery is located at least partly between the second side of the speaker housing and at least a portion of the earphone housing. The earphone comprises a retaining mechanism configured to retain the speaker housing and the earphone housing in a mechanical relationship with each other. The earphone comprises a locking mechanism for locking and unlocking of the retaining mechanism. The locking mechanism is configured to maintain the retaining mechanism in an operation configuration when locked and to allow the user to manipulate the retaining mechanism into a service configuration by repositioning the speaker housing relative to the earphone housing when unlocked. The earphone is configured such that the battery compartment is inaccessible for replacement of the battery, when the retaining mechanism is in the operation configuration, and such that the battery compartment is accessible for replacement of the battery, when the retaining mechanism is in the service configuration. The retaining mechanism further is configured to allow the speaker housing and the earphone housing to move relative to each other, when the retaining mechanism is in the operation configuration.

It is an advantage of the earphone that the battery compartment is arranged such that the replaceable battery is located at least partly between the second side of the speaker housing and the earphone housing. The replaceable battery can be accessed by repositioning the speaker housing relative to the earphone housing to uncover the battery compartment of the earphone. The battery can be accessed by detaching or moving the speaker housing from the earphone or earphone housing. The battery can be accessed by the user from a first side of the earphone which is facing towards the ear of the user when the earphone is worn by the user or wearer for its intended operational use.

It is an advantage that there is no need for a battery lid on a second outward facing side or surface of the earphone, such as e.g. on the surface of the earphone housing facing towards the surroundings when the earphone is worn on the ear of the user. When there is no battery lid on the second outside surface of the earphone housing, there are fewer parts of the outside of the earphone which can break, be lost or be harmed etc. For example in some prior art earphones the battery lid may unintentionally or accidentally open or break as the user's hands or fingers or other devices may touch the outside surface of the earphone either when the earphone is in use on the user's head or when the earphone is not in use but lying or hanging on a desk or stand/support/base. Furthermore, when there is no battery lid on the second outside surface of the earphone housing, the appearance or look of the earphone may be more visually pleasing as there are fewer parts on the second outside facing surface. Also, there is more space available for control elements, such as e.g. volume control buttons. The terms second side and second outside facing surface and second outside surface and second outward side and second surface may be used interchangeably throughout the specification. The earphone may comprise a wearing device, such as a headband, an ear hook or the like, for securing the earphone to the head of the wearer, and the wearing device may be attached to the earphone housing. In such embodiments, it is a further advantage that the wearing device can be attached to the second outward facing side of the earphone without interfering with e.g. a lid of a battery compartment.

Thus in order to replace the battery, the earphone is changed from the operation configuration to the service configuration by repositioning the speaker housing relative to the earphone housing to obtain access to the battery compartment for replacement of the battery. The user, wearer or another person may reposition the speaker housing relative to the earphone housing with their fingers. The user, wearer or another person may remove the discharged, old or used battery with their fingers and place the recharged or new battery in the battery compartment in the earphone.

The battery compartment is accessible for a user or person for replacement of the battery, when the earphone is in the service configuration. When the battery has been replaced, the earphone may be changed back to the operation configuration by repositioning the speaker housing relative to the earphone housing.

It is an advantage that the earphone comprises a locking mechanism for locking and unlocking of the retaining mechanism, as the locking mechanism is configured to maintain the retaining mechanism in an operation configuration when locked and to allow the user to manipulate the retaining mechanism into a service configuration by repositioning the speaker housing relative to the earphone housing when unlocked.

It is an advantage that the battery compartment is inaccessible or not accessible for replacement of the battery, when the retaining mechanism is in the operation configuration, and it is an advantage that the battery compartment is accessible for replacement of the battery, when the retaining mechanism is in the service configuration, since hereby the battery can only be changed when the user actively brings the retaining mechanism, and thereby the earphone, into the service configuration. In the present context, the battery compartment is inaccessible for replacement of the battery if a user cannot replace the battery without either changing the retaining mechanism into the service configuration or perform one or more operations on the earphone that a regular user would not normally be expected to perform. Such operations may comprise e.g. a major disassembly of the earphone, breaking parts of the earphone, removing a larger number of components of the earphone or the like.

In the following, "unlocking the earphone" and "locking the earphone" shall mean the same as respectively unlocking or locking the retaining mechanism. The same applies respectively to "unlocking the locking mechanism" and "locking the locking mechanism". Similarly, a statement indicating the earphone being in a particular one of the operation configuration and the service configuration shall mean the same as a statement indicating the retaining mechanism being in that configuration.

It is an advantage that the retaining mechanism is configured to allow the speaker housing and the earphone housing to move relative to each other, when the retaining mechanism is in the operation configuration, since this may provide comfort for the user wearing the earphone on their ear.

The earphone may also be termed an earcup. The hearing device may be a headset or headphone.

The earphone is configured to be worn at the ear of a user, such as over the ear of the user, and/or on the ear of the user, and/or covering the ear of the user, and/or covering the ear canal of the user.

The earphone may also comprise an ear cushion at the first side of the speaker housing, where the ear cushion may be configured to be removed before changing the earphone from the operation configuration to the service configuration by repositioning the speaker housing relative to the earphone housing. Alternatively, if the ear cushion is small and attached to the speaker housing, the ear cushion may not need to be removed from the earphone before repositioning the speaker housing relative to the earphone housing. As a further alternative, if the ear cushion is large and attached to the earphone housing, the ear cushion may have a central opening allowing the user to manipulate the retaining mechanism and the speaker housing through the central opening without removing the ear cushion from the earphone. The ear cushion may be an integrated part of the earphone, such as an integrated part of the speaker housing. The ear cushion may be detachable from the earphone or the ear cushion may be fixed to the earphone.

It is an advantage of the earphone that the replaceable battery can be accessed from the speaker housing-side of the earphone. The replaceable battery can be accessed by repositioning the speaker housing relative to the earphone housing to uncover the battery compartment of the earphone. The battery can be accessed by detaching or moving the speaker housing from the earphone or earphone housing. The battery can be accessed from the first side of the earphone which is facing towards the ear of the user, when the earphone is worn by the user or wearer for its intended operational use.

The earphone housing may comprise electronic parts of the earphone. The earphone housing may be configured to accommodate the speaker housing. The earphone housing may be configured to comprise and/or accommodate the battery and/or the battery compartment.

The earphone comprises a speaker housing comprising an output transducer for reproduction of audio signals. The output transducer may be a speaker, a speaker driver, a loudspeaker, an acoustic output transducer etc.

The speaker housing is a part of the earphone. The speaker housing comprises the output transducer. The speaker housing may comprise electronic parts connected or related to the output transducer. The speaker housing may comprise other electronic parts of the earphone. The speaker housing may be configured to accommodate the earphone housing. The speaker housing may be configured to comprise and/or accommodate the battery and/or the battery compartment.

The earphone comprises a battery compartment for accommodating a replaceable battery. The battery compartment may be arranged between the speaker housing and the earphone housing of the earphone. The battery compartment may be arranged in the speaker housing. The battery compartment may be arranged at least partly in the speaker housing. The battery compartment may be arranged in the earphone housing. The battery compartment may be arranged at least partly in the earphone housing. The battery compartment may be provided partly in the speaker housing and/or partly in the earphone housing. The battery compartment may be arranged in neither the speaker housing nor in the earphone housing, for example the battery compartment may be arranged between the speaker housing and the earphone housing.

The battery compartment may be detachable from both the speakerphone housing and the earphone housing and thus constitute a separate component comprising one or more walls or other structures for retaining the battery. Alternatively and/or additionally, one or more walls or structures of the battery compartment—or all of these—may be constituted by walls or structures of the speakerphone housing and/or the earphone housing. In other words, in some embodiments, the battery compartment may be a space between the speakerphone housing and the earphone housing configured to be filled out by the battery and/or configured to hold, retain or accommodate the battery.

The battery compartment and/or the speaker housing and/or the earphone housing may have a circular shape, and/or be circular circumferential. The diameter of the battery compartment may be substantially similar to the diameter of the speaker housing and/or the earphone housing.

The earphone is configured to be changed between an operation configuration and a service configuration by the user performing a repositioning of the speaker housing relative to the earphone housing. Thus the earphone is configured to be in at least two different configurations or positions.

The operation configuration is for normal use of the earphone or for operational use of the earphone, e.g. for listening to audio input. The operation configuration is not e.g. for replacing the battery. The operation configuration may be a closed configuration or closed position of the earphone. In the operation configuration the speaker housing is retained by the earphone housing in a way that enables normal/operational use of the earphone. In the operation configuration the battery compartment is not accessible. In the operation configuration there may be full or complete contact between the speaker housing and the earphone housing. There may be a larger freedom of movement between the speaker housing and the earphone housing in the service configuration than in the operation configuration, such that the user can access the battery in the service configuration.

The service configuration is for service of the earphone such as for replacing the battery of the earphone. Thus the service configuration may not be e.g. for listening to audio input. The service configuration may be an open configuration or open position of the earphone. In the service configuration the speaker housing and the earphone housing are positioned relative to each other such that the battery compartment is accessible to the user. In the service configuration there may be no or only little contact between the speaker housing and the earphone housing. If the speaker housing can be removed completely from the earphone, there may be no contact between the speaker housing and the earphone and/or the earphone housing, when the earphone is in the service configuration. If the speaker housing cannot be removed completely from the earphone, there may be for example contact at one bearing, e.g. a single bearing connecting the speaker housing and the earphone and/or the earphone housing, when the earphone is in the service configuration. The bearing may be e.g. a hinge, such as a ball hinge.

The battery compartment is accessible for replacement of the battery, when the earphone is in the service configuration.

The earphone is configured to allow the user to change the earphone between the operation configuration and the service configuration. Thus the earphone is configured to allow the user to shift and/or switch and/or modify and/or transform and/or alternate and/or vary the earphone between the operation configuration and the service configuration.

The earphone is configured such that the user can change the earphone between an operation configuration and a service configuration by repositioning the speaker housing relative to the earphone housing. The change between the operation configuration and the service configuration may be by the user performing a repositioning and/or a movement and/or a transformation and/or a modification and/or an alternation of the speaker housing relative to the earphone housing.

The repositioning of the speaker housing relative to the earphone housing may comprise one or more of rotation and/or displacement and/or longitudinal repositioning and/or translational repositioning and/or pivoting and/or tilting and/or turning and/or twisting and/or separation and/or detachment and/or division.

In some embodiments the battery compartment is arranged in the earphone housing and is accessible to a user from the first side of the earphone housing when the retaining mechanism is in the service configuration. Thus the battery compartment may be comprised in the earphone housing and/or be part of the earphone housing. Thus, the earphone housing may comprise the battery compartment. Thus the battery compartment may be arranged for ensuring that the battery compartment and therefore also the battery do not cover or interfere with the audio signals outputted from the output transducer and intended to be received in the ear canal of the user of the earphone.

In some embodiments the battery compartment is arranged in the speaker housing and is accessible to a user from the second side of the speaker housing when the retaining mechanism is in the service configuration. Thus the battery compartment may be comprised in the speaker housing and/or be part of the speaker housing. Thus the speaker housing may comprise the battery compartment. The speaker housing may thus comprise both the output transducer and the battery compartment. For ensuring that the battery compartment and therefore also the battery do not cover or interfere with the audio signals outputted from the output transducer and configured to be received in the ear canal of the user of the earphone, the battery compartment is arranged opposite the output transducer in the speaker housing. Thus the output transducer may be arranged at the first side of the speaker housing facing towards the ear of the user when the earphone is worn by the user. The battery compartment may then be arranged in the end or second side of the speaker housing, which is configured to face away from the user's ear when the earphone is worn on the user's head.

In some embodiments the retaining mechanism is configured to allow the user to manipulate the retaining mechanism into the service configuration of the earphone by rotating, around a first axis, the speaker housing relative to the earphone housing. The purpose of the rotation may be for changing between the operation configuration and the service configuration. The starting point may be the operation configuration, and thus in order to change the earphone to the service configuration from the operation configuration, the speaker housing may be rotated around a first axis relative to the earphone housing, such as to open the earphone. In order to change the earphone back from the service configuration to the operation configuration, the speaker housing may be rotated around the first axis relative to the earphone housing in the opposite direction, such as to close the earphone. The retaining mechanism may be configured to enable a rotation of the speaker housing relative to the earphone housing across a first angle range spanning from 0 degrees up to 360 degrees. However, in order to access the battery compartment, the first angle range may span e.g. at least 90 degrees, such as be 100 degrees. The first angle range may span at least be 180 degrees as this may allow that the earphone can lie flat and steady on a horizontal surface, such as a table top, when the battery is replaced. Thus the earphone may be configured to allow rotation of the speaker housing relative to the earphone housing around the first axis across a first angle range spanning at least 90 degrees, such as at least 120 degrees, such as at least 150 degrees, such as at least 180 degrees, such as at least 210.

In some embodiments the retaining mechanism comprises a tilting mechanism providing that the speaker housing is tiltable and/or pivotable, around a second axis, relative to the earphone housing. Thus in addition to, or alternatively to, the rotation of the speaker housing relative to the earphone housing around the first axis, the speaker housing may be tiltable and/or pivotable relative to the earphone housing around a second axis. The purpose of the tilting mechanism may be to provide comfort for the wearer of the earphone, as the tilting mechanism may provide that the earphone adapt its position or angle or inclination to the wearer's ear. The retaining mechanism may be configured to enable tilt of the speaker housing relative to the earphone housing around the second axis across a second angle range spanning less than 90 degrees, such as less than 75 degrees, such as less than 60 degrees, such as less than 45 degrees, such as less than 30 degrees, such as less than 15 degrees.

A further mechanism may be provided to enable tilting, rotation and/or pivoting between the earphone housing and a wearing device, such as a headband or the like.

In some embodiments the retaining mechanism and/or the tilting mechanism may comprise a first bearing and a second bearing arranged opposite each other with respect to the speaker housing and each configured to mechanically connect the speaker housing and the earphone housing. The tilting mechanism may comprises the first and the second bearing which provide that the speaker housing is attached to the earphone housing at the first and a second bearing. The first and the second bearing may be arranged opposite each other with respect to the speaker housing. Thus the second axis may extend through the first and the second bearing. One or both of the bearings may be detachable. Thus the speaker housing may be detached and attached again to the earphone housing at one or both of the bearings. The first bearing may be a fixation bearing, such as a bearing which cannot be detached, or which is not supposed to be detached during normal operation and normal service configurations. Thus the speaker housing may be detachably attached to the earphone housing at a second bearing. The speaker housing may be fixedly attached to the earphone at the first bearing, thus the first bearing may be a fixation bearing. In order to provide a suitable tilting mechanism the first and the second bearings may each comprise a first bearing member arranged in or at the earphone housing and a second bearing member arranged in or at the speaker housing.

The earphone, the earphone housing and/or the speaker housing may have a circular shape. Thus the first and the second bearings may be arranged with an angular distance of 180 degrees relative to the circular shape.

In some embodiments the first bearing comprises a hinge. The first bearing may be a hinge or comprise a hinge. The hinge may be a detachable hinge or a non-detachable hinge. If the first bearing is a hinge, it is an advantage that the speaker housing is still attached to the earphone housing when the earphone is brought into the service configuration, where the speaker housing may be removed from the earphone housing in order to replace the battery. Thus even though the speaker housing is moved away from the earphone housing by the repositioning of the speaker housing relative to the earphone housing, the speaker housing may still be attached at the first bearing, whereby the speaker housing is not completely separated from the earphone housing. Thus the speaker housing may not be lost during battery replacement, as the speaker housing is attached to the earphone housing at the first bearing. It may also be less likely that the speaker housing is broken, when it is not separated from the earphone housing.

Alternatively, the speaker housing may be removed completely, such as detached at the first bearing, from the earphone housing, when the earphone is brought into service configuration. Thus the hinge may be a detachable hinge. Alternatively, the bearing may not be a hinge. Thus, the detachable attachment or bearing between the speaker housing and the earphone housing may be provided by means of for example press-fitting or by sliding or displacement on tracks.

In some embodiments the hinge of the first bearing is a ball hinge providing that the speaker housing is rotatable around the first axis and/or around the second axis and/or around a third axis relative to the earphone housing. The ball hinge may be termed a ball bearing hinge. A ball hinge may allow for rotation in three dimensions, such as rotation around an X-axis and/or a Y-axis and/or a Z-axis. A ball hinge may allow for rotation around the first axis and/or the second axis and/or a third axis. The ball hinge may be restricted in its rotation around one or more of the axes, such as providing a restriction member or rotation or movement limitation component at the ball hinge, such as at the speaker housing and/or at the earphone housing. By providing that the first bearing is a ball hinge, the speaker housing may be repositioned relative to the earphone housing in one or more degrees of freedom. It is an advantage of the ball hinge that in order to change the earphone from the operation configuration to the service configuration, a user can rotate the speaker housing first around the third axis, such as clockwise, and then rotate it around the first axis in order to lift the speaker housing from the earphone housing to obtain access to the battery compartment. In order to change the earphone back from the service configuration to the operation configuration, the user can rotate the speaker housing back down to the earphone housing around the first axis, and then rotate it back around the third axis, such as counterclockwise.

In some embodiments the hinge comprises a canal. An electrical wire connecting the earphone housing and the speaker housing may extend through the canal. It is an advantage that the electrical wire extends through a canal of the hinge, since hereby the wire is retained in the hinge whereby it is not free to move, and the wire may not inadvertently be pulled by the user when the earphone is in the service configuration, and the wire may not unintentionally obstruct the assembly of the speaker housing and the earphone housing when changing the earphone from the service configuration to the operation configuration.

In some embodiments the second bearing comprises the locking mechanism for locking and unlocking the retaining mechanism. Thus the second bearing may comprise the locking mechanism that allows locking the speaker housing to the earphone housing when the earphone is in the operation configuration. When the user wishes to change the earphone from the operation configuration to the service configuration, the user may unlock the locking mechanism. When the user wishes to change the earphone from the service configuration to the operation configuration, the user may lock the locking mechanism. When the earphone comprises the locking mechanism, it is an advantage that the earphone may not change configuration unintentionally, e.g. if the earphone is dropped, the earphone does not change configuration, as the locking mechanism prevents that the earphone can change from operation configuration to service configuration without the user actively, deliberately and with purpose is activating or unlocking the locking mechanism.

In some embodiments the locking mechanism comprises a first lever configured to be activated, and the second bearing is configured to be detached in dependence on the first lever being activated. The locking mechanism may be arranged at least partly on the earphone housing and at least partly on the speaker housing. The first lever may be arranged on the earphone housing. The first lever may be activated by the user by pushing or pressing the first lever, e.g. inwards, towards the speaker housing. Alternatively, the first lever may be arranged on the speaker housing, and the first lever may be activated by the user by pushing or pressing the first lever towards the earphone housing. The first lever may prevent the second bearing from being detached when it is not activated and allow the first bearing to be detached when it is activated. After activating the first lever, the user may thus detach the second bearing. Preferably, the second bearing may be configured to allow the user to detach it by rotating the speaker housing relative to the earphone housing around the third axis. The first lever may prevent rotation of the speaker housing relative to the earphone housing around the third axis when it is not activated. The retaining mechanism may be configured to allow rotation of the speaker housing relative to the earphone housing around the third axis across a third angle range spanning less than 45 degrees, such as an angle less than 30 degrees, such as an angle less than 15 degrees. The second bearing may comprise a recess and a protrusion or pin. The protrusion may be configured to slide or be displaced in the recess for detaching or attaching the second bearing. The recess may be provided in or be part of the earphone housing. The protrusion may be arranged on or be part of the speaker housing. Thus the locking mechanism may be configured to prevent repositioning of the speaker housing relative to the earphone housing by preventing displacement of the protrusion in the recess.

In some embodiments the second bearing is a bayonet mount configured to be released by rotation, around the third axis, upon activation of the first lever. The bayonet mount is a mechanical attachment or bearing which may comprise a male side with one or more radial protrusions or pins, and a female receptor with a matching recess or slot(s), such as L-shaped slots, to keep the two parts locked together. The slots may be shaped like a capital letter L with serif, the serif being a short upward segment at the end of the horizontal arm. The protrusion or the pin slides into the recess or into the vertical arm of the "L", slides along the horizontal arm, then may be pushed slightly upwards into the short vertical "serif", e.g. by spring force. Alternatively, the locking mechanism and/or the second bearing may be comprise other types of bearing or mount, e.g. press-fitting or other types of locking means etc.

According to an aspect disclosed is a hearing device comprising an earphone according to any of the previous mentioned aspects and/or embodiments.

Within this document, the term "earphone" refers to a device that is configured to be worn at, on or in one ear of an individual (the wearer or user) and is capable of providing an audible acoustic output signal to the wearer. An earphone may itself constitute a hearing device, or it may be comprised by a hearing device, such as e.g. a headset, a headphone, a hearing protector or a hearing aid. Hearing devices may e.g. be used for conveying audio signals in an audible format to a person, for augmenting a normal-hearing person's hearing capability, for protecting a person's hearing capability while allowing the person to hear sounds from the environment and/or for compensating for a hearing-impaired person's loss of hearing capability.

An earphone may e.g. be configured to be worn over the ear (circumaurally), i.e. such that it covers the pinna completely, on the ear (supraurally), i.e. such that it covers a portion of the pinna, or in the ear, i.e. such that a portion of the earphone protrudes towards or into the ear canal. An earphone may be configured in other known ways, including combinations of and compromises between two or more of the above mentioned configurations. An earphone may preferably be retained in position at, on or in the ear by a wearing device, such as e.g. a headband, a neckband, an earhook or the like. The wearing device may be an integral part of the earphone and/or of the hearing device. An earphone is preferably configured to emit an acoustic signal such that it may enter the wearer's ear canal and thus may be heard by the wearer.

In general, a hearing device is configured to be worn—at least partly—at or on the wearer's head, typically comprises one or two earphones and is capable of providing one or more audible acoustic output signals to at least one of the wearer's ears. A hearing device may thus be monaural or binaural. One or more of the acoustic output signals are preferably provided in the form of an air-borne acoustic signal that is emitted such that it may reach one or both of the wearer's outer ears.

A hearing device may provide one or more of the acoustic output signals in dependence on one or more audio input signals, such as e.g. electronically received audio signals, acoustic signals received from the wearer's surroundings and/or audio signals stored or generated in the hearing device. A hearing device may comprise one or more receivers or input transducers for electronically receiving one or more audio input signals. A receiver may comprise an electric connector, e.g. arranged in a housing part of the hearing device or at the distal end of a cable extending from the hearing device, to which another device may be electrically connected to provide one or more audio input signals. A receiver may be adapted to receive one or more audio input signals wirelessly using any known wireless transmission signals, such as e.g. radio frequency signals, optical signals or acoustic signals. A receiver may be adapted to receive wired or wireless signals as analog signals and/or as digital signals and may comprise demodulators and/or decoders for deriving one or more audio input signals from one or more modulated and/or encoded wired or wireless transmission signals.

A hearing device may comprise one or more input transducers for receiving one or more acoustic input signals from the wearer's surroundings and providing corresponding audio input signals. A hearing device may comprise one or more signal processing circuits adapted to apply any combination of known signal processing, such as e.g. amplification, attenuation, noise reduction, noise cancelling, echo cancelling, frequency filtering, spatial filtering, reduction of acoustic feedback, level compression etc., in an audio signal path or in multiple audio signal paths receiving the one or more audio input signals and providing the one or more acoustic output signals in dependence on the one or more audio input signals.

A hearing device may comprise one or more own-voice microphones arranged to receive the wearer's voice and adapted to provide one or more corresponding voice audio signals as well as one or more transmitters adapted to transmit one or more voice audio signals to another device connected to the hearing device, such as e.g. base station, a mobile phone, a computer or the like.

In general, an earphone comprises an output transducer for providing an audible acoustic output signal to a wearer in dependence on an audio output signal. An earphone may comprise one or more of the receivers of the hearing device, and/or one or more of the input transducers of the hearing device, and/or one or more of the signal processing circuits of the hearing device, and/or one or more of the own-voice microphones of the hearing device, and/or one or more of the transmitters of the hearing device. Thus, the functions of receiving, providing and/or processing the one or more audio input signals as well as the functions of receiving and/or transmitting voice audio signals may reside entirely in an earphone, or they may be distributed in any suitable fashion between an earphone and further parts of a hearing device comprising the earphone. An earphone may receive the audio output signal from another device. Alternatively, or additionally, an earphone may receive one or more, possibly pre-processed, audio input signals and process one or more of the audio input signals and/or pre-processed audio input signals to provide the audio output signal. In the following, any audio signal received by an earphone is referred to as an "earphone audio signal". An earphone audio signal may thus comprise e.g. an acoustic input signal, an audio input signal, a pre-processed audio input signal and/or an audio output signal. An earphone may e.g. provide one or more received earphone audio signals directly to the output transducer, or it may transduce and/or process one or more received earphone audio signals and provide the one or more transduced and/or processed earphone audio signals to the output transducer.

The term "hearing system" refers to a system comprising multiple devices of which at least one is a hearing device. A hearing system may comprise multiple hearing devices and/or one or more auxiliary devices. Auxiliary devices are devices that communicate with one or more of the hearing devices and affect—and/or benefit from—the function of the hearing devices. Auxiliary devices may be e.g. base stations, remote controls, audio gateway devices, mobile phones, public-address systems, car audio systems, personal computers and/or music players.

Within this document, the singular forms "a", "an", and "the" are intended to include the plural forms as well (i.e. to have the meaning "at least one"), unless expressly stated otherwise. Correspondingly, the terms "has", "includes", "comprises", "having", "including" and "comprising" specify the presence of respective features, operations, elements and/or components, but do not preclude the presence or addition of further entities. Furthermore, when an element is referred to as being "connected" or "coupled" to another element, this includes direct connection/coupling and connection/coupling via intervening elements, unless expressly stated otherwise. The term "and/or" includes any and all combinations of one or more of the associated items. The steps or operations of any method disclosed herein need not be performed in the exact order disclosed, unless expressly stated otherwise. Ordinal attributes, such as "primary", "secondary", "first", "second", "main" and "auxiliary", are intended to allow the reader to distinguish between different elements, and should not be construed as implying any element hierarchy or dependency, unless expressly stated otherwise.

The present invention relates to different aspects including the earphone, hearing device and method described above and in the following, and corresponding system parts, methods, devices, systems, networks, kits, uses and/or product means, each yielding one or more of the benefits and advantages described in connection with the first mentioned aspects, and each having one or more embodiments corresponding to the embodiments described in connection with the first mentioned aspects and/or disclosed in the appended claims.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
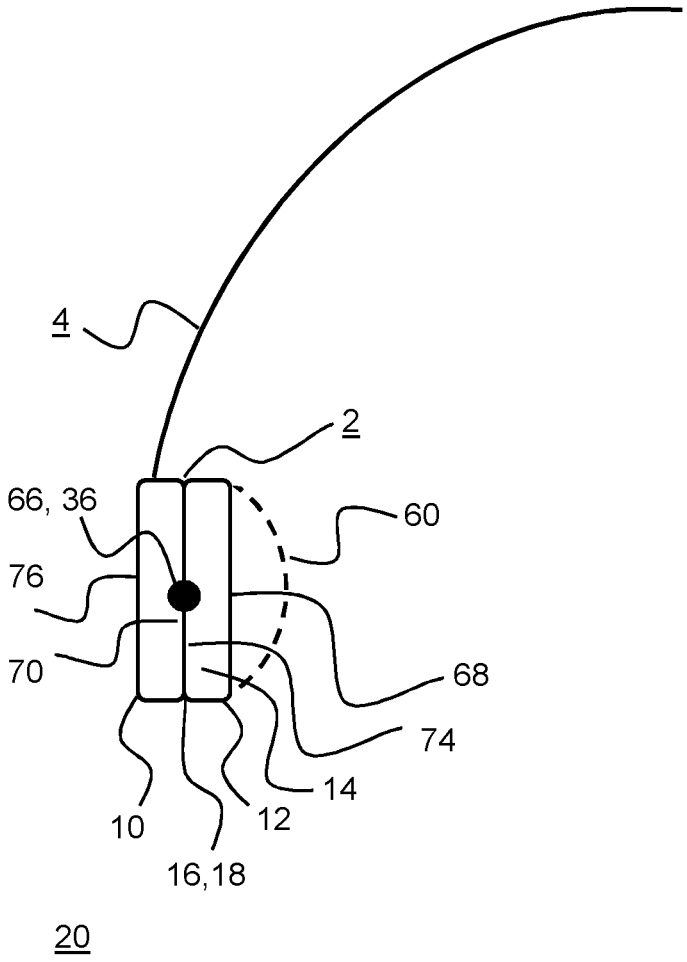
FIG. 1 schematically illustrates an example of an earphone for a hearing device.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

FIG. 1 schematically illustrates an example of an earphone 2 for a hearing device 4. The earphone 2 is configured to be worn at the ear of a user. The earphone 2 comprises a speaker housing 12 comprising an output transducer 14 for reproduction of audio signals. The speaker housing 12 has a first side 68 configured to face towards the ear of the user when the earphone 2 is worn by the user. The speaker housing 12 has a second side 74 opposite the first side 68. The earphone 2 comprises an earphone housing 10 configured to retain the speaker housing 12. The earphone 2 comprises a battery compartment 16 for accommodating a replaceable battery 18, such that the replaceable battery 18 is located at least partly between the speaker housing 12 and at least a portion of the earphone housing 10. The earphone 2 comprises a retaining mechanism 66 configured to retain the speaker housing 12 and the earphone housing 10 in a mechanical relationship with each other. The earphone 2 comprises a locking mechanism 36 for locking and unlocking of the retaining mechanism 66. The locking mechanism 36 is configured to maintain the retaining mechanism 66 in an operation configuration 20 when locked and to allow the user to manipulate the retaining mechanism 66 into a service configuration (not shown) by repositioning the speaker housing 12 relative to the earphone housing 10 when unlocked. The battery compartment 16 is not accessible for replacement of the battery 18, when the retaining mechanism 66 is in the operation configuration 20. The battery compartment 16 is accessible (not shown) for replacement of the battery 18, when the retaining mechanism 66 is in the service configuration (not shown). The retaining mechanism 66 is further configured to allow the speaker housing 12 and the earphone housing 10 to move relative to each other, see for example FIG. 3*c*)-3*d*), when the retaining mechanism 66 is in the operation configuration 20. Optionally, the earphone 2 may comprise an ear cushion 60.

Figure 2A:
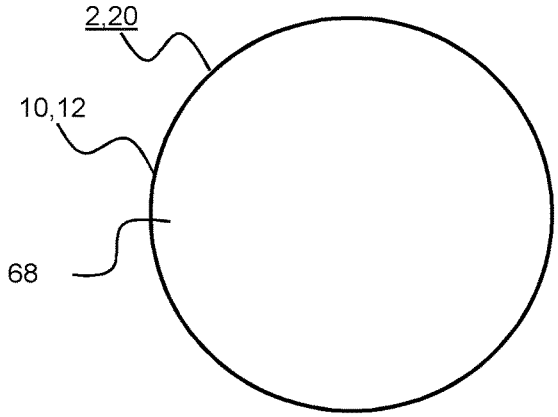
FIG. 2*a*-2*c* schematically illustrate an example where the earphone is configured to change between an operation configuration and a service configuration FIG. 3*a*-3*d* schematically illustrate an example where the earphone comprises a tilting mechanism.
Figure 2B:
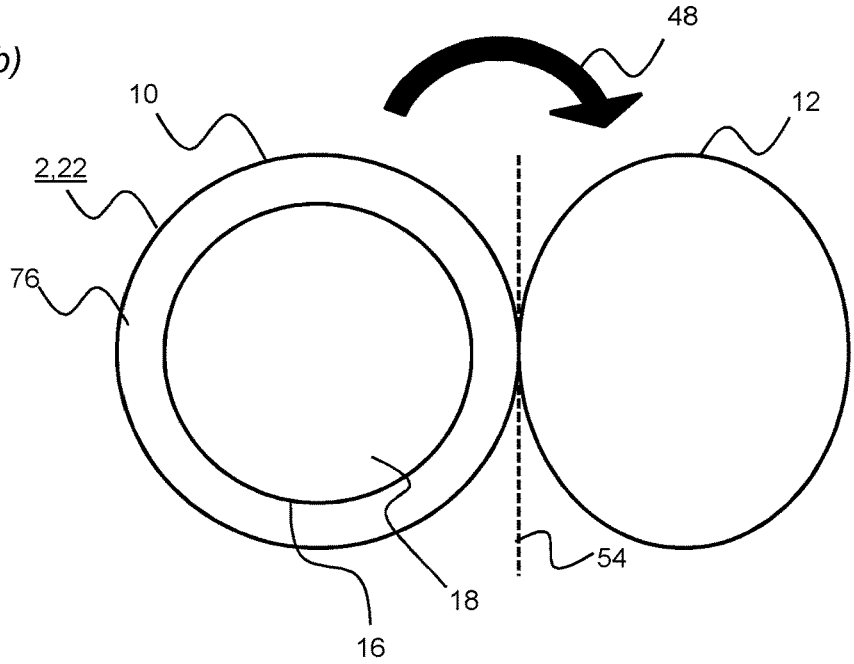
Figure 2C:
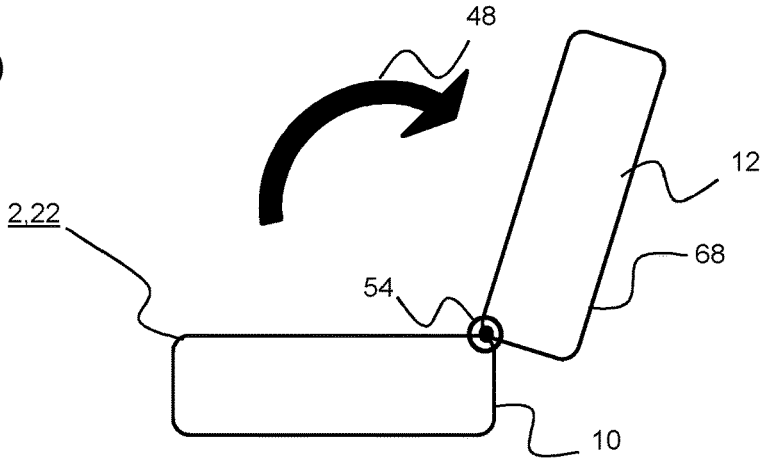

FIG. 2*a*-2*c* schematically illustrate an example where the earphone 2 is configured to be changed between an operation configuration 20 and a service configuration 22. FIG. 2*a* shows the earphone 2, comprising the earphone housing 10 and the speaker housing 12, in the operation configuration 20, as seen from above with the first side 68 of the speaker housing 12 facing upwards. FIG. 2*b* shows the earphone 2 in the service configuration 22 as seen from above with the first side 70 of the earphone housing 10, the battery 18 and the battery compartment 16 facing upward. The battery compartment 16 is accessible for replacement of the battery 18, when the earphone 2 is in the service configuration 22. The service configuration 22 of the earphone 2 may be obtained by rotating, around a first axis 54, the speaker housing 12 relative to the earphone housing 10. In order to change the earphone 2 back from the service configuration 22 to the operation configuration (FIG. 2*a*), the speaker housing 12 may be rotated around the first axis 54 relative to the earphone housing 10 in the opposite direction, such as to close the earphone 2. FIG. 2*c* shows the earphone 2 in the service configuration 22 as seen from the side. The arrow 48 indicates rotation of the speaker housing 12 relative to the earphone housing 10 around the first axis 54 for changing the earphone 2 into the service configuration 22.

Figure 3A:
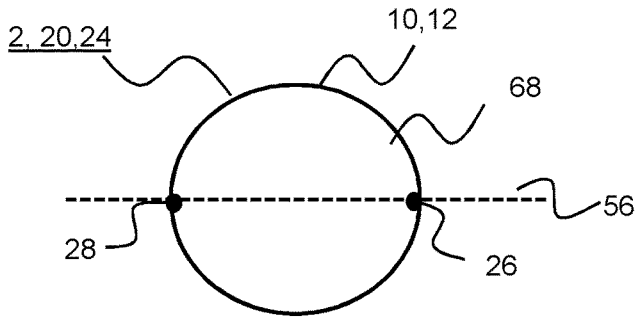
Figure 3B:
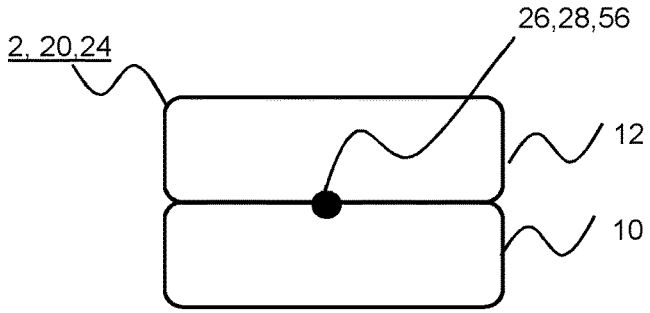
Figure 3C:
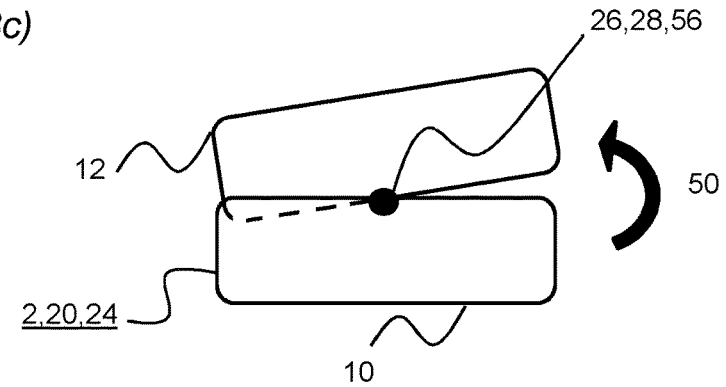
Figure 3D:
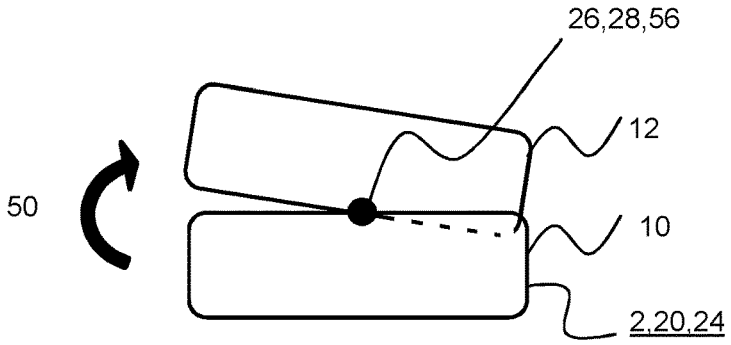

FIG. 3*a*-3*d* schematically illustrate an example where the earphone 2 comprises a tilting mechanism 24. FIG. 3*a* shows the earphone 2, comprising the earphone housing 10 and the speaker housing 12, in the operation configuration 20 as seen from above with the first side 68 of the speaker housing 12 facing upward. FIG. 3*b*-3*d* show the earphone 2, comprising the earphone housing 10 and the speaker housing 12, in the operation configuration 20 as seen from the side. The tilting mechanism 24 is provided by the speaker housing 12 being attached to the earphone housing 10 through two bearings 26, 28 arranged opposite each other, with respect to the speaker housing 12, providing that the speaker housing 12 is tiltable and/or pivotable, in a first direction 50 around a second axis 56, relative to the earphone housing 10. The second axis 56 extends through the two bearings 26, 28. FIG. 3*c*) shows that the speaker housing 12 tilts counter-clockwise relative to the earphone housing 10 around the second axis 56. FIG. 3*d*) shows that the speaker housing tilts clockwise relative to the earphone housing 10 around the second axis 56.

Figure 4A:
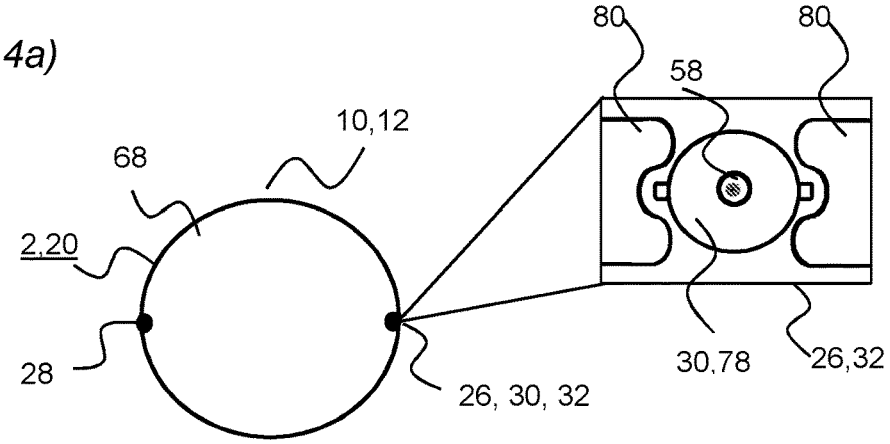
FIG. 4*a*-4*c* schematically illustrate an example where the first bearing comprises a hinge.
Figure 4B:
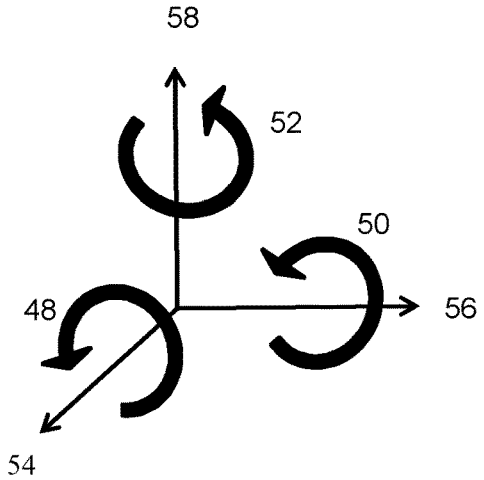
Figure 4C:
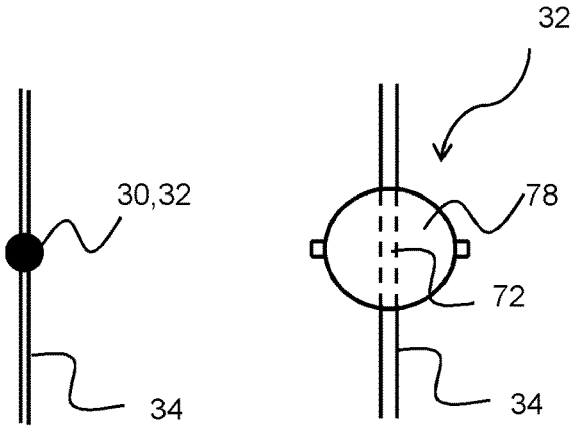

FIG. 4*a*-4*c* schematically illustrate an example where the first bearing 26 comprises a hinge 30. FIG. 4*a* shows the earphone 2, comprising the earphone housing 10 and the speaker housing 12, in the operation configuration 20 as seen from above with the first side 68 of the speaker housing 12 facing upwards. The first bearing 26 comprises a hinge 30, which may be a ball hinge 32. The ball hinge 32 may be configured to restrict rotation of a ball 78 of the hinge 32 around a third axis 58 as seen in the expanded view box in FIG. 4*a*). Thus restriction components 80 or material may be arranged near the ball hinge 32 and/or on the ball 78 to cooperatively prevent the ball hinge 32 from moving freely in all degrees of freedom. FIG. 4*b* shows the three dimensions in which a hinge, such as ball hinge, may rotate. The hinge 30 may rotate around a first axis 54 and/or a second axis 56 and/or a third axis 58. The hinge 30 may rotate in a first direction 48 around the first axis 54 and/or in a second direction 50 around the second axis 56 and/or in a third direction 52 around the third axis 58. FIG. 4*c* shows that an electrical wire 34 may extend through a canal 72 in the hinge 30, e.g. in the ball part of a ball hinge 32.

Figure 5A:
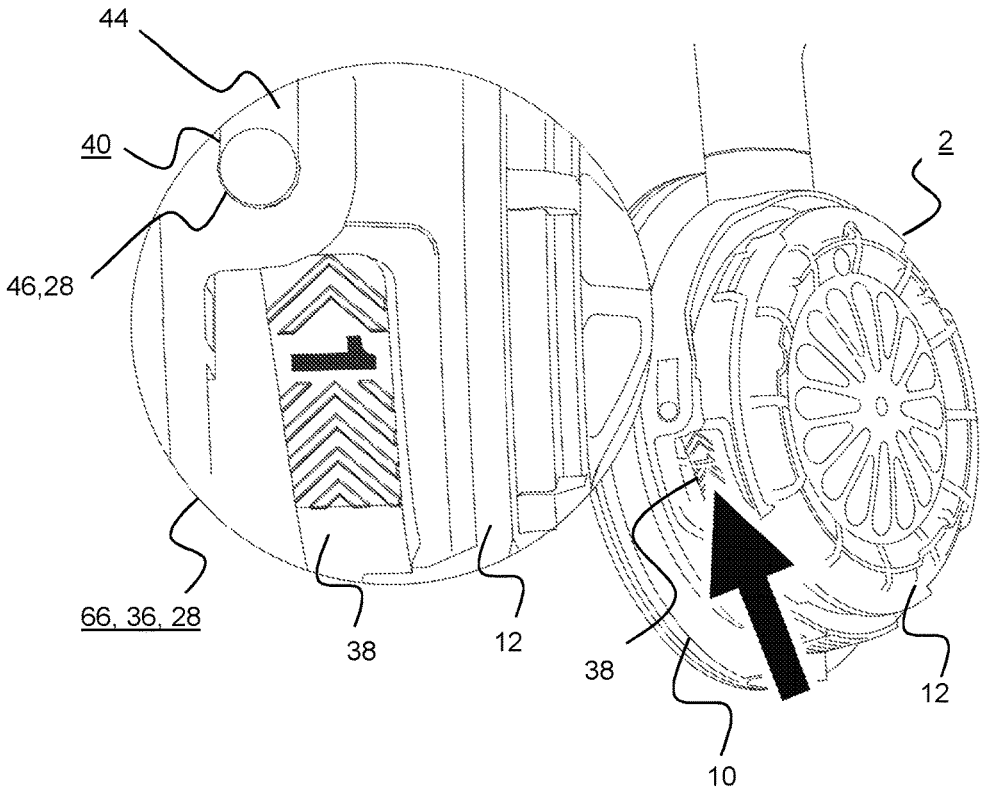
FIG. 5*a*-5*c* schematically illustrate an example where the earphone comprises a locking mechanism FIG. 6*a*-6*f* schematically illustrate an example of a process of replacing the battery of the earphone.
Figure 5B:
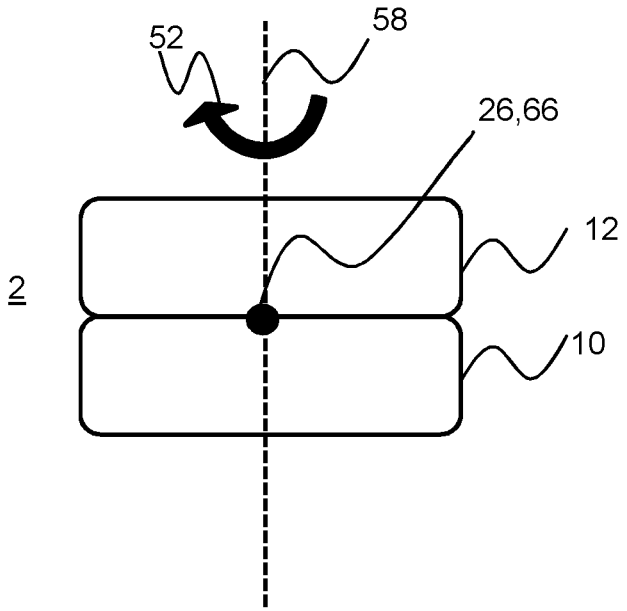
Figure 5C:
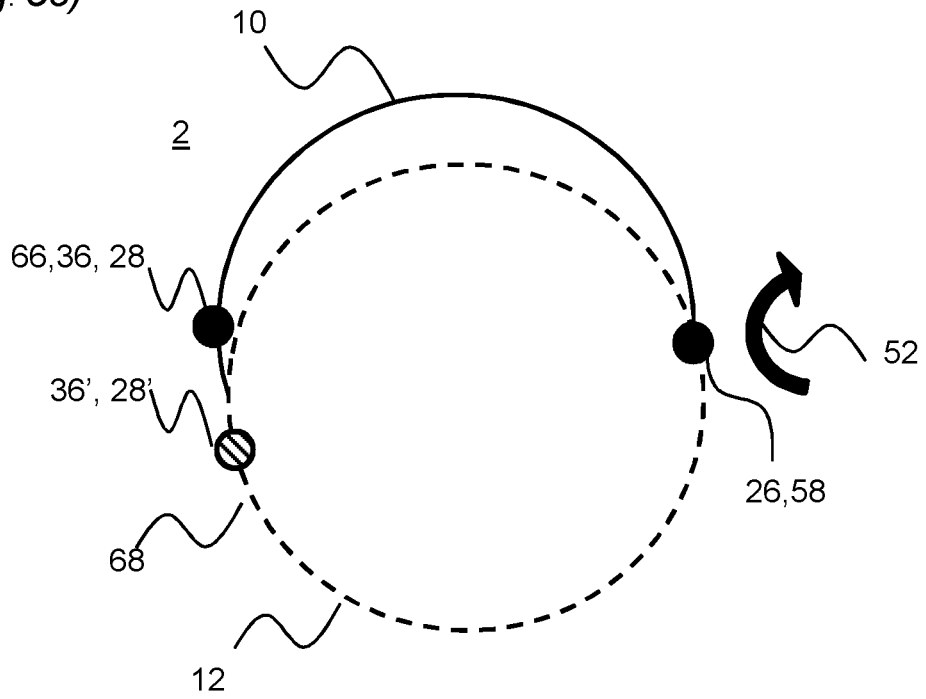

FIG. 5*a*-5*c* schematically illustrate an example where the earphone 2 comprises a locking mechanism 36. The second bearing 28 comprises the locking mechanism 36 for locking and unlocking of the retaining mechanism 66. FIG. 5*a* shows an expanded view of the locking mechanism 36 of the earphone 2. FIG. 5*a*) shows that the locking mechanism 36 comprises a first lever 38 configured to be activated and that the second bearing 28 is configured to be detached upon activation of the first lever 38. The first lever 38 is marked with the number "1" in FIG. 5*a*). The second bearing 28 may comprise a bayonet mount 40. The second bearing 28 comprises a protrusion 46 and a recess 44. The protrusion 46 is configured to slide or be displaced in the recess 44 for detaching and attaching the second bearing 28. The recess 44 may be provided in or be part of the earphone housing 10. The protrusion 46 may be arranged on or be part of the speaker housing 12. Thus the second bearing 28 may be detached or attached at least partly by displacing the protrusion 46 in the recess 44. The protrusion and recess may be arranged in other ways, such as e.g. reversed such that the protrusion 46 is in the speaker housing 12 and the recess 44 is in the earphone housing 10. FIG. 5*b* shows the earphone 2 as seen from the side. Detaching of the second bearing 28 is obtained by rotating the speaker housing 12, around a third axis 58, relative to the earphone housing 10. The third axis 58 extends through the first bearing 26. FIG. 5*c* shows the earphone 2 as seen from above with the first side 68 of the speaker housing 12 facing upward. Detaching the second bearing 28 brings the earphone 2 into a configuration that is neither an operation configuration nor a service configuration, but a configuration in between the operation configuration and the service configuration. The speaker housing 12 is rotated or displaced relative to the earphone housing 10 around the third axis 58 after unlocking of the locking mechanism 36. The second axis 56 extends through the protrusion 46 when the retaining mechanism 66 is in the operation configuration. The protrusion 46 has a shape allowing it to rotate in the recess 44 and thus allowing the speaker housing 12 and the earphone housing to tilt with respect to each other around the second axis 56. When the speaker housing 12 is rotated relative to the earphone housing 10 around the third axis 58 upon unlocking of the locking mechanism 36, and/or the retaining mechanism 66, the second bearing 28 is divided, separated or detached, such that the first and second bearing members of the second bearing 28 move away from each other, as indicated by the marks 36' and 28' in FIG. 5*c*).

Figure 6A:
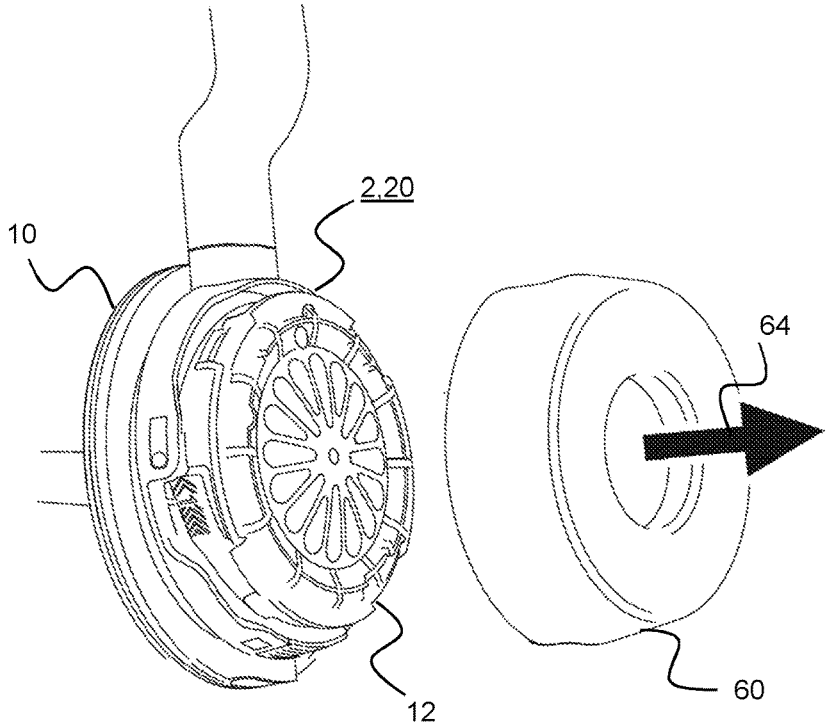
Figure 6B:
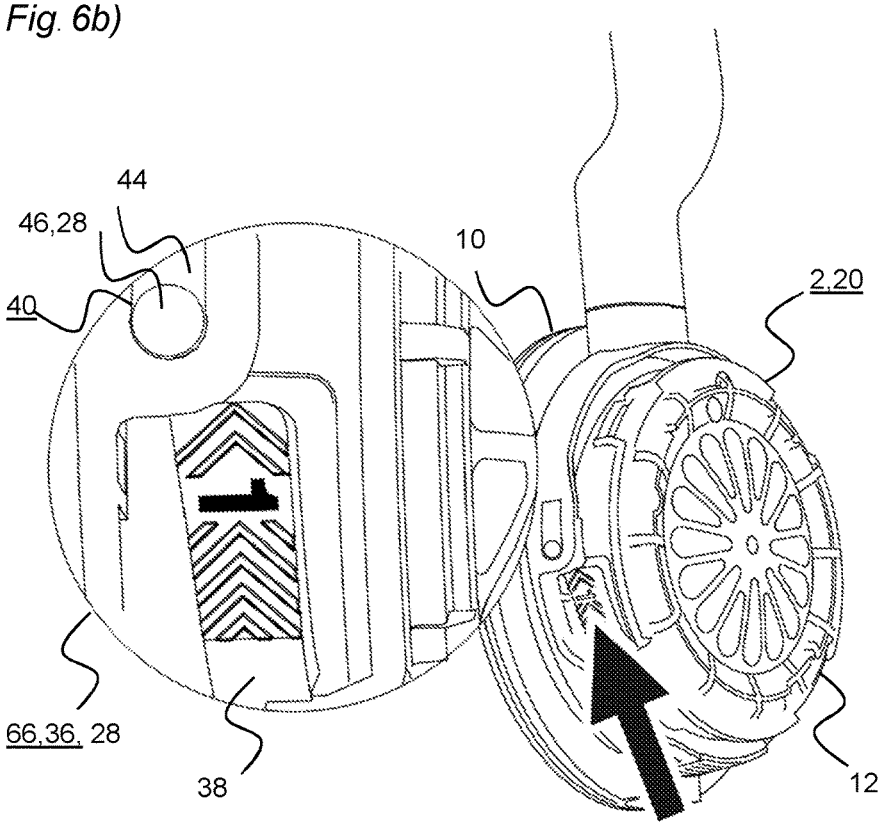
Figure 6C:
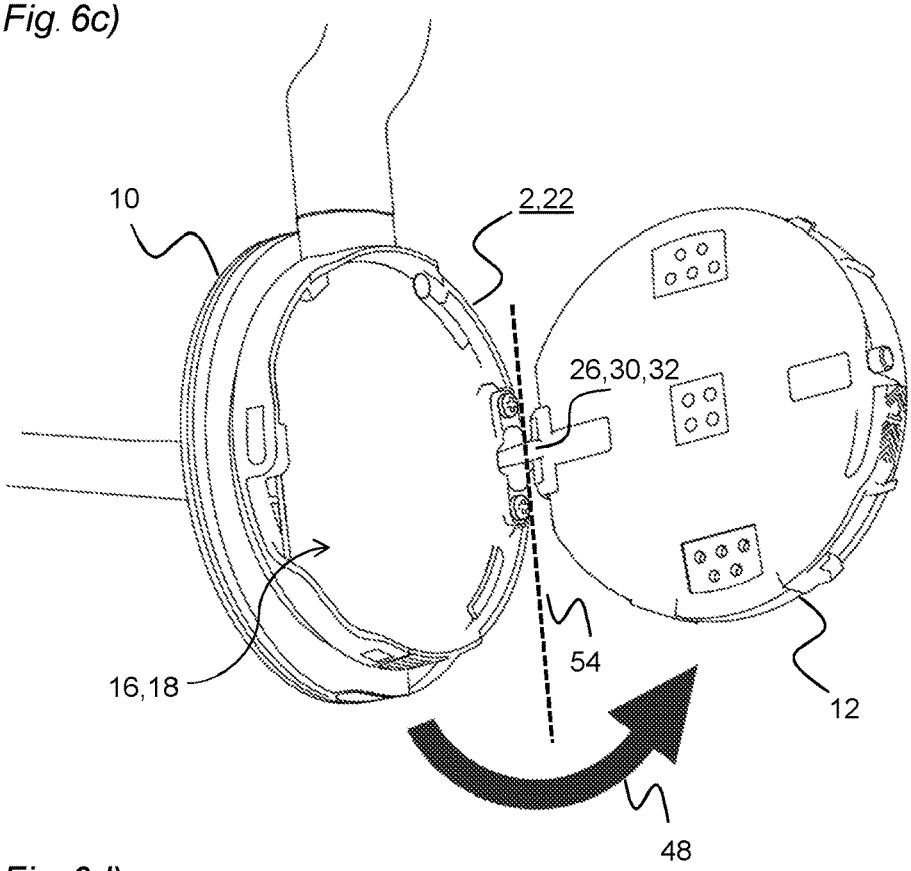
Figure 6D:
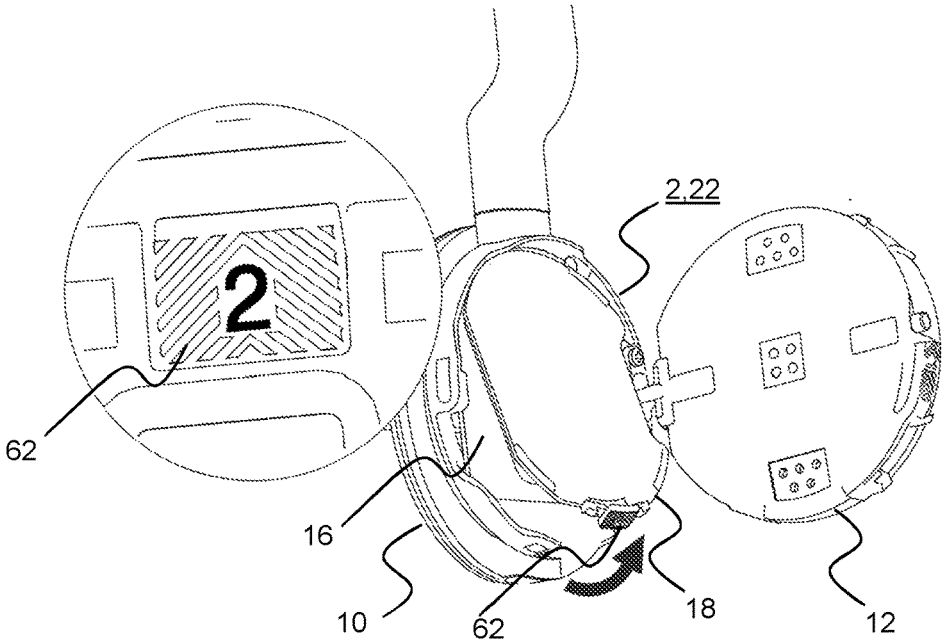
Figure 6E:
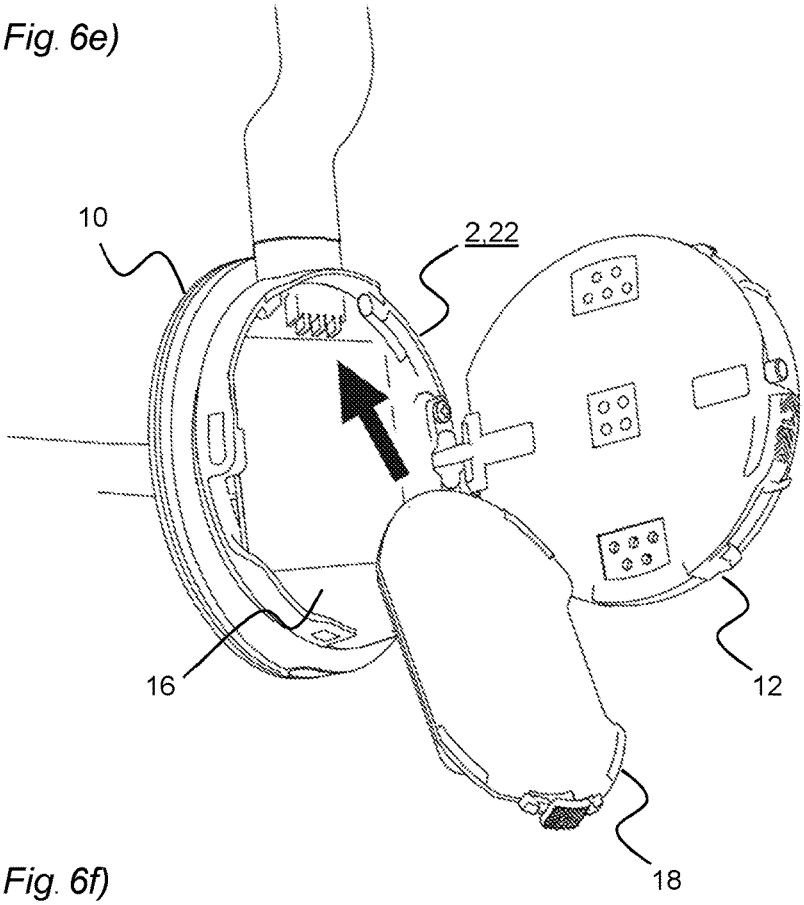
Figure 6F:
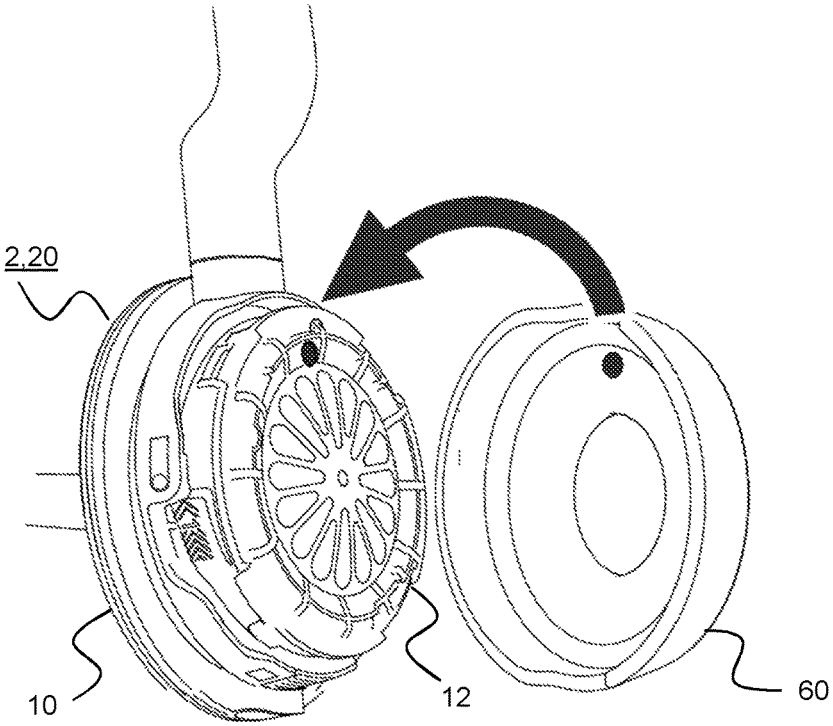

FIG. 6*a*-6*f* schematically illustrate an example of a process of replacing the battery 18 of the earphone 2. In order to replace the battery 18, the user changes the earphone 2 from the operation configuration 20 to the service configuration 22 by operating the locking mechanism 36 to unlock the retaining mechanism 66 and subsequently repositioning the speaker housing 12 relative to the earphone housing 10 to obtain access to the battery compartment 16 for replacement of the battery 18. FIG. 6*a* shows that the ear cushion 60 is first removed by the user before changing from the operation configuration 20 of the earphone 2. The ear cushion may be removed by pulling the ear cushion in a direction away from the earphone as indicated by the arrow 64. FIG. 6*b* shows an expanded view of the locking mechanism 36 of the earphone 2. FIG. 6*b*) shows that when the earphone 2 is in the operation configuration 20, the retaining mechanism 66 is unlocked by the user activating the first lever 38 by pushing or pressing the first lever 38 towards the speaker housing 12. After the first lever 38 is activated, the bayonet mount 40 can be detached by the user. The user rotates the speaker housing 12 relative to the earphone housing 10 around the third axis 58 (see FIG. 5*c*). The second bearing 28 comprises a protrusion 46 and a recess 44. The protrusion 46 is configured to slide or be displaced in the recess 44 by the user. The recess 44 may be provided in or be part of the earphone housing 10. The protrusion 46 may be arranged on or be part of the speaker housing 12. Thus the locking mechanism 36 may be configured to enable the user to detach and attach the second bearing 28 by displacing the protrusion 46 in the recess 44. FIG. 6*c* shows that the battery 18 and the battery compartment 16 are accessible when the earphone 2 has been changed by the user into the service configuration 22 by the user repositioning the speaker housing 12 relative to the earphone housing 10. After the unlocking of the locking mechanism 24 as seen in FIG. 6*b*), the speaker housing 12 can be rotated by the user relative to the earphone housing 10 around the first axis 54 at the first bearing 26 being a hinge 30, such as a ball hinge 32. Thereby the speaker housing 12 can be lifted or rotated away from the earphone housing 10 by the user thereby exposing or uncovering the battery 18 and/or the battery compartment 16 for replacement. In the service configuration 22, the user has access to the battery compartment 16 and the battery 18 from the first side 70 of the earphone housing 10. FIG. 6*d* shows that the battery 18, such as an old or used battery, is removed from the battery compartment 16, by the user activating a second lever 62, when the earphone 2 is in the service configuration 22. The second lever 62 is marked with the number "2" in FIG. 6*d*) for indicating to the user that this is the second lever to activate when replacing the battery 18. The first lever to activate by the user was the first lever 38 marked with "1" in FIGS. 6*a*) and 6*b*). The second lever 62 may be accessible or be configured to be activated by the user only when the earphone 2 is in the service configuration. FIG. 6*d*) shows an expanded view of the second lever 62 of the earphone 2. FIG. 6*e* shows that the battery 18, such a new or recharged battery, is inserted by the user into the battery compartment 16 of the earphone 2. FIG. 6*f* shows that when the earphone 2 has been changed back to the operation configuration 20 by the user repositioning the speaker housing 12 relative to the earphone housing 10 in the reverse order as shown in FIG. 6*b*)-6*d*), the ear cushion 60 is reattached to the earphone 2 by the user.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly, to be regarded in an illustrative rather than restrictive sense. The claimed invention is intended to cover all alternatives, modifications and equivalents.

LIST OF REFERENCES

2 earphone
4 hearing device
10 earphone housing
12 speaker housing
14 output transducer
16 battery compartment
18 battery
20 operation configuration of earphone
22 service configuration of earphone
24 tilting mechanism
26 first bearing
28 second bearing
30 hinge
32 ball hinge
34 electrical wire
36 locking mechanism
38 first lever
40 bayonet mount
44 recess
46 protrusion
48 first direction
50 second direction
52 third direction
54 first axis
56 second axis
58 third axis
60 ear cushion
62 second lever
64 arrow indicating direction away from the earphone
66 retaining mechanism
68 first side of the speaker housing
70 first side of the earphone housing
72 canal in hinge
74 second side of the speaker housing
76 second side of the earphone housing
78 ball of ball hinge
80 restriction component

The invention claimed is:

1. An earphone for a hearing device, wherein the earphone is configured to be worn at an ear of a user, the earphone comprising:

a speaker housing comprising an output transducer for reproduction of audio signals, wherein the speaker housing has a first side configured to face towards the ear of the user when the earphone is worn by the user, and a second side opposite the first side;

an earphone housing configured to retain the speaker housing such that the second side of the speaker housing faces a first side of the earphone housing, wherein the earphone housing has as a second side opposite the first side;

a battery compartment for accommodating a replaceable battery, such that the replaceable battery is located at least partly between the second side of the speaker housing and at least a portion of the earphone housing;

wherein the earphone comprises two end points about which the speaker housing tilts relative to the earphone housing, a retaining mechanism configured to retain the speaker housing and the earphone housing in a mechanical and tiltable relationship with each other;

wherein the earphone comprises a locking mechanism located generally at least one of said end points for locking and unlocking of the retaining mechanism, wherein the locking mechanism is configured to maintain the retaining mechanism in an operation configuration when locked and to allow the user to manipulate the retaining mechanism into a service configuration by repositioning the speaker housing relative to the earphone housing when unlocked;

wherein the earphone is configured such that the battery compartment is inaccessible for replacement of the battery, when the retaining mechanism is in the operation configuration, and such that the battery compartment is accessible for replacement of the battery, when the retaining mechanism is in the service configuration;

wherein the retaining mechanism further is configured to allow the speaker housing and the earphone housing to tilt relative to each other along an axis defined between said two end points, when the retaining mechanism is in the operation configuration; and wherein the retaining mechanism comprises a tilting mechanism providing that the speaker housing is tiltable, around said axis, relative to the earphone housing, when the retaining mechanism is in the operation configuration; and wherein the speaker housing is capable of tilting on said two ends points and, when said locking mechanism is released, from one of said end points, the speaker housing is capable of pivoting on only one of said end points, to allow access to the battery compartment.

2. The earphone according to claim 1, wherein the battery compartment is arranged in the earphone housing and is accessible to a user from the first side of the earphone housing when the retaining mechanism is in the service configuration.

3. The earphone according to claim 1, wherein the battery compartment is arranged in the speaker housing and is accessible to a user from the second side of the speaker housing when the retaining mechanism is in the service configuration.

4. The earphone according to claim 1, wherein the retaining mechanism is configured to allow the user to manipulate the retaining mechanism into the service configuration of the earphone by rotating, around a first axis, the speaker housing relative to the earphone housing.

5. The earphone according to claim 1, wherein the tilting mechanism comprises a first and a second bearing providing that the speaker housing is attached to the earphone housing at the first and the second bearing, where the first and the second bearing are arranged opposite each other with respect to the speaker housing.

6. The earphone according to claim 5, wherein the first bearing comprises a hinge.

7. The earphone according to the claim 6, wherein the hinge of the first bearing is a ball hinge providing that the speaker housing is rotatable around the first axis and around the second axis and around a third axis relative to the earphone housing.

8. The earphone according to claim 7, wherein the hinge comprises a canal and wherein an electrical wire connecting the earphone housing and the speaker housing extends through the canal.

9. The earphone according to claim 7, wherein the second bearing comprises a bayonet mount configured to be released by rotation, around the third axis, upon activation of the first lever.

10. The earphone according to claim 5, wherein the locking mechanism comprises the second bearing for locking and unlocking of the retaining mechanism.

11. The earphone according to claim 5, wherein the locking mechanism comprises a first lever configured to be activated by a user and thereby enable the user to detach the second bearing for unlocking of the retaining mechanism.

12. An earphone for a hearing device, wherein the earphone is configured to be worn at the an ear of a user, the earphone comprising:

a speaker housing comprising an output transducer for reproduction of audio signals, wherein the speaker housing has a first side configured to face towards the ear of the user when the earphone is worn by the user, and a second side opposite the first side;

an earphone housing configured to retain the speaker housing such that the second side of the speaker housing faces a first side of the earphone housing, wherein the earphone housing has as a second side opposite the first side;

a battery compartment for accommodating a replaceable battery, such that the replaceable battery is located at least partly between the second side of the speaker housing and at least a portion of the earphone housing;

wherein the earphone includes first and second pivot points about which the speaker housing pivots relative to the earphone housing in one plane, one of said two pivot points being a hinge and the other of said two pivot points including a retaining mechanism to retain the speaker housing and the earphone housing in a mechanical and pivotable relationship with each other;

wherein the retaining mechanism includes a locking mechanism located generally at the other of said two points for locking and unlocking of the retaining mechanism, wherein the locking mechanism is configured to maintain the retaining mechanism in an operation configuration when locked and to allow the user to manipulate the retaining mechanism into a service configuration by repositioning the speaker housing relative to the earphone housing when unlocked;

wherein the earphone is configured such that the battery compartment is inaccessible for replacement of the battery, when the retaining mechanism is in the operation configuration, and such that the battery compartment is accessible for replacement of the battery, when the retaining mechanism is in the service configuration;

wherein the retaining mechanism further is configured to allow the speaker housing and the earphone housing to pivot relative to each other along an axis defined between said two pivot points, when the retaining mechanism is in the operation configuration;

and wherein the speaker housing is capable of tilting on said two pivot points and, when said locking mechanism is released, from one of said two pivot points, the speaker housing is capable of pivoting on only one of said two pivot points, to allow access to the battery compartment.

* * * * *